US008800987B2

(12) United States Patent
Kimura et al.

(10) Patent No.: US 8,800,987 B2
(45) Date of Patent: Aug. 12, 2014

(54) SHEET CONVEYING DEVICE AND IMAGE FORMING APPARATUS WITH THE SAME

(75) Inventors: Masaharu Kimura, Osaka (JP); Kohji Aoki, Osaka (JP); Yoshiyuki Kobayashi, Osaka (JP); Norichika Katsura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/813,994

(22) PCT Filed: Jul. 14, 2011

(86) PCT No.: PCT/JP2011/066105

§ 371 (c)(1),
(2), (4) Date: Mar. 13, 2013

(87) PCT Pub. No.: WO2012/017801

PCT Pub. Date: Feb. 9, 2012

(65) Prior Publication Data

US 2013/0187334 A1 Jul. 25, 2013

(30) Foreign Application Priority Data

Aug. 6, 2010 (JP) ..... 2010-177576

(51) Int. Cl.
*B65H 29/70* (2006.01)
*B65H 5/06* (2006.01)
*B65H 1/00* (2006.01)

(52) U.S. Cl.
USPC ..... 271/188; 271/272; 271/161

(58) Field of Classification Search
USPC ..... 271/161, 188, 209, 272
See application file for complete search history.

(56) References Cited

U.S. PATENT DOCUMENTS

| | | | | |
|---|---|---|---|---|
| 5,927,709 | A * | 7/1999 | Greive | 271/188 |
| 7,200,356 | B2 * | 4/2007 | Kawamoto | 399/405 |
| 7,677,561 | B2 * | 3/2010 | Matsumoto et al. | 271/272 |
| 8,235,383 | B2 * | 8/2012 | Masaki et al. | 271/188 |
| 8,256,769 | B2 * | 9/2012 | Takahira et al. | 271/272 |
| 8,267,402 | B2 * | 9/2012 | Saito | 271/301 |
| 8,336,878 | B2 * | 12/2012 | Tozaki et al. | 271/225 |

(Continued)

FOREIGN PATENT DOCUMENTS

| | | |
|---|---|---|
| JP | 09-030704 | 2/1997 |
| JP | 10-139251 | 5/1998 |

(Continued)

OTHER PUBLICATIONS

International Search Report for corresponding International Application No. PCT/JP2011/066105 mailed Sep. 6, 2011.

*Primary Examiner* — Patrick Cicchino
(74) *Attorney, Agent, or Firm* — Renner, Otto, Boisselle & Sklar, LLP

(57) ABSTRACT

A sheet conveying device (30) includes a plurality of first conveyance rollers (31) and a plurality of second conveyance rollers (32). The sheet conveying device (30) includes stiffening rollers (34). The stiffening rollers (34) are disposed coaxially with at least one conveyance rollers (32) among the first and second conveyance rollers (31) and (32), and have diameters larger than diameters of the conveyance rollers (32). The stiffening rollers (34) includes first stiffening rollers (34*a*), which apply conveying forces to a sheet (P), and second stiffening rollers (34*b*), which apply smaller conveying forces to the sheet (P) than the conveying forces to the sheet (P) in the first stiffening rollers (34*a*).

20 Claims, 10 Drawing Sheets

(56) References Cited

U.S. PATENT DOCUMENTS

| | | | | |
|---|---|---|---|---|
| 8,408,538 | B2 * | 4/2013 | Miyazaki et al. | 271/188 |
| 8,523,175 | B2 * | 9/2013 | Kobayashi et al. | 271/188 |
| 2002/0049674 | A1 | 4/2002 | Tamamoto et al. | |
| 2002/0135124 | A1 * | 9/2002 | Suzuki et al. | 271/303 |
| 2006/0163803 | A1 * | 7/2006 | Izuchi et al. | 271/272 |
| 2006/0181004 | A1 * | 8/2006 | Kayama et al. | 271/188 |
| 2012/0119431 | A1 * | 5/2012 | Kobayashi et al. | 271/3.19 |

FOREIGN PATENT DOCUMENTS

| | | |
|---|---|---|
| JP | 2002-197507 | 7/2002 |
| JP | 2004-352425 | 12/2004 |
| JP | 2005-067786 | 3/2005 |
| JP | 2005-272111 | 10/2005 |
| JP | 2006-151617 | 6/2006 |
| JP | 2009-269695 | 11/2009 |

* cited by examiner

FIG.6

| DESTINATION | ROLLER POSITION/CONFIGURATION | | | |
|---|---|---|---|---|
| | 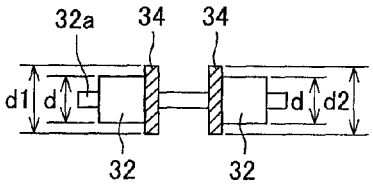 | | 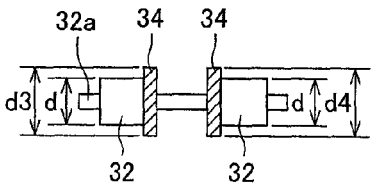 | |
| | d1(mm) | d2(mm) | d3(mm) | d4(mm) |
| JAPANESE (CENTIMETER) SPECIFICATION | ϕ 20 | ϕ 20 | ϕ 20 | ϕ 20 |
| NORTH AMERICA (INCH) SPECIFICATION | | | | |
| EUROPEAN (CENTIMETER) SPECIFICATION | | ϕ 21 | ϕ 21 | |

FIG.7

| STIFFENING ROLLER | ROLLER POSITION/CONFIGURATION | | | | ABNORMAL SOUND | REAR END REMAINING |
|---|---|---|---|---|---|---|
| | 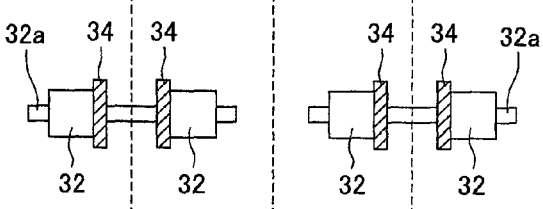 | | | | | |
| | 1 | 2 | 3 | 4 | | |
| COMPARATIVE EXAMPLE 1 | LOCKED | LOCKED | LOCKED | LOCKED | × | ○ |
| COMPARATIVE EXAMPLE 2 | FREE | FREE | FREE | FREE | ○ | × |
| EMBODIMENT | FREE | LOCKED | LOCKED | FREE | ○ | ○ |

FIG.8

(a) COMPARATIVE EXAMPLE 1 (b) EMBODIMENT

| DESTINATION | PAPER TYPE (GRAMMAGE g/m²) | PAPER CLASSIFICATION | BEFORE COUNTERMEASURE | | | AFTER COUNTERMEASURE | | |
|---|---|---|---|---|---|---|---|---|
| | | | A4/LT (8.5×11 [INCH]) | B4/LGL (8.5×14 [INCH]) | A3/WLT (17×11 [INCH]) | A4/LT (8.5×11 [INCH]) | B4/LGL (8.5×14 [INCH]) | A3/WLT (17×11 [INCH]) |
| JAPANESE SPECIFICATION PAPER | PAPER A (82) | PLAIN PAPER | ○ | ○ | ○ | ○ | ○ | ○ |
| | PAPER B (64) | PLAIN PAPER | ○ | × | × | ○ | ○ | ○ |
| | PAPER C (70) | PLAIN PAPER | ○ | × | × | ○ | ○ | ○ |
| | PAPER D (64) | PLAIN PAPER | ○ | × | × | ○ | ○ | ○ |
| | PAPER E (64) | PLAIN PAPER | ○ | × | × | ○ | ○ | ○ |
| | PAPER F (68) | PLAIN PAPER | ○ | × | × | ○ | ○ | ○ |
| | PAPER G (67) | RECYCLED PAPER | ○ | × | × | ○ | ○ | ○ |
| | PAPER H (64) | RECYCLED PAPER | ○ | × | × | ○ | ○ | ○ |
| | PAPER I (64) | PLAIN PAPER | ○ | × | × | ○ | ○ | ○ |
| | PAPER J (68) | PLAIN PAPER | ○ | --- | × | ○ | --- | ○ |
| NORTH AMERICA SPECIFICATION PAPER | PAPER K (90) | PLAIN PAPER | ○ | ○ | ○ | ○ | ○ | ○ |
| | PAPER L (75) | PLAIN PAPER | ○ | × | × | ○ | ○ | ○ |
| | PAPER M (75) | PLAIN PAPER | ○ | × | △ | ○ | ○ | ○ |
| | PAPER N (105) | PLAIN PAPER | ○ | --- | ○ | ○ | --- | ○ |
| | PAPER O (80) | PLAIN PAPER | ○ | × | × | ○ | ○ | ○ |
| | PAPER P (75) | RECYCLED PAPER | ○ | --- | × | ○ | --- | ○ |
| EUROPEAN SPECIFICATION PAPER | PAPER Q (90) | PLAIN PAPER | ○ | --- | ○ | ○ | --- | ○ |
| | PAPER R (80) | PLAIN PAPER | ○ | --- | ○ | ○ | --- | ○ |
| | PAPER S (100) | PLAIN PAPER | ○ | --- | ○ | ○ | --- | ○ |
| | PAPER T (80) | RECYCLED PAPER | ○ | --- | △ | ○ | --- | ○ |

SHEET CONVEYING DEVICE AND IMAGE FORMING APPARATUS WITH THE SAME

TECHNICAL FIELD

The present invention relates to a sheet conveying device applicable to an image forming apparatus such as a printer, a copying machine, and a multifunction printer, and also relates to an image forming apparatus.

BACKGROUND ART

A sheet conveying device included in an image forming apparatus is required to stack sheets aligned on a discharge tray for conveyance of the sheets with high stacking quality to the discharge tray in the case where the sheet conveying device conveys a sheet such as an original and a recording paper, which is processed after an image reading process or an image forming process in the image forming apparatus.

FIGS. 9A and 9B are explanatory views illustrating an exemplary conventional sheet conveying device A1 that degrades stacking quality. FIG. 9A is a schematic side view illustrating a discharged state of a sheet P conveyed to a discharge tray B4 viewed from an axial direction X of conveyance rollers B1 and B2. FIG. 9B is a schematic side view illustrating a conveying state of the sheet P viewed from a conveying direction Y of the sheet P.

The sheet conveying device A1 illustrated in FIGS. 9A and 9B includes a plurality of the first conveyance rollers B1 disposed coaxially with one another, and a plurality of second conveyance rollers B2 disposed coaxially with one another. The second conveyance rollers B2 face the respective plurality of first conveyance rollers B1. The sheet conveying device A1 conveys the sheet P while sandwiching the sheet P between the rotatably driven first conveyance rollers (drive rollers secured to a drive roller shaft E1) B1 and the second conveyance rollers (driven rollers secured to the driven roller shaft E2) B2. The first conveyance rollers B1 are rotatably driven while the second conveyance rollers B2 rotate in association with the rotation of the first conveyance roller B1.

This conventional sheet conveying device A1 easily causes inconvenience such as the following. When the sheet P is conveyed to one side Y1 in the conveying direction Y, the downstream side end (leading end) P1 is weighed down at one side Y1 in the conveying direction Y of the sheet P and the leading end P1 is brought in contact with the discharge tray B4 early. This early contact of the leading end P1 of the sheet P with the discharge tray B4 causes an upperstream side end (the rear end) P2, which is disposed at one side Y1 in the conveying direction Y, hooked into the second conveyance rollers B2 after the sheet P is conveyed (what is called rear end remaining (see a portion α in FIG. 9A)). Alternatively, the sheet P curled by a fixing process may degrade stacking quality.

CITATION LIST

Patent Literature

PATENT LITERATURE 1: Japanese Unexamined Patent Application Publication No. 2006-151617

SUMMARY OF INVENTION

Technical Problem

In view of this, stiffening rollers B3 may be disposed (see FIGS. 10A and 10B) in order to prevent the leading end P1 of the sheet P from being weighed down immediately when the sheet P is conveyed to one side Y1 in the conveying direction Y from the sheet conveying device A1, to prevent the rear end P2 from remaining by the rear end P2 of the sheet P hooked into the conveyance roller B2, or to reduce curling of the sheet P caused in the fixing process. The stiffening rollers B3 are disposed coaxially with at least one conveyance roller (the first conveyance rollers B1 at the upper side in the examples illustrated in FIGS. 10A and 10B as described below) among the first and second conveyance rollers B1 and B2. The stiffening rollers B3 have diameters larger than diameters of the rollers B1.

FIGS. 10A and 10B are explanatory views illustrating the exemplary conventional sheet conveying device A2 where the stiffening rollers B3 are disposed. FIG. 10A is a schematic side view illustrating a discharged state of the sheet P, which is conveyed to the discharge tray B4, viewed from the axial direction X of the conveyance rollers B1 and B2. FIG. 10B is a schematic side view illustrating a conveying state of the sheet P viewed from the conveying direction Y of the sheet P.

The sheet conveying device A2 illustrated in FIGS. 10A and 10B includes the stiffening rollers B3 disposed coaxially with the first conveyance rollers B1 in the sheet conveying device A1 illustrated in FIGS. 9A and 9B. The stiffening rollers B3 have diameters larger than diameters of the first conveyance rollers B1. The stiffening rollers B3 are configured to integrally rotate with the first conveyance rollers B1 (which are secured to the drive roller shaft E1 in the drawing). That is, the individual stiffening rollers B3 are each configured to apply conveying forces to the sheet P.

When this conventional sheet conveying device A2 conveys the sheet P to one side Y1 in the conveying direction Y, the stiffening rollers B3 corrugates the sheet P in the axial direction X. This stiffens the sheet P to maintain a conveying posture of the sheet P as much as possible, thus preventing the leading end P1 of the sheet P from being weighed down early, the rear end remaining of the sheet P, or preventing a fixed curl of the sheet P.

Although this conventional sheet conveying device A2 allows the stiffening rollers B3 to prevent the leading end P1 of the sheet P from being weighed down early, to prevent the rear end remaining of the sheet P, or to prevent the fixed curl of the sheet P, another inconvenience is caused as follows. The inconvenience relates to corrugation of the sheet P by the stiffening rollers B3. Especially, in the case where the sheet P is guided to a curved conveyance path D (see FIG. 11 described later) curved in the conveying direction Y, the sheet P corrugated in the axial direction X is conveyed to the curved conveyance path D curved in the conveying direction Y. This causes abnormal sound.

FIG. 11 is a schematic cross-sectional view of the exemplary conventional sheet conveying device A2 viewed from the axial direction X. FIG. 11 illustrates a state where the sheet P corrugated in the axial direction X is conveyed to the curved conveyance path D curved in the conveying direction Y.

As illustrated in FIG. 11, the sheet P is conveyed (switch backed) in the conveying direction Y2 by the conveyance rollers B1 and B2 that are reversely rotated by switchback function. In the case where the sheet P is guided to the curved conveyance path D (in this example, a reverse conveying path for reversing front and back sides of the sheet P when images are formed on both sides), the sheet P, which is corrugated in the axial direction X by the stiffening rollers B3, is forcibly curved along the curved conveyance path D, which is curved in the conveying direction Y. When the corrugation is restored to the original condition, abnormal sound (specifically, a crunching sound) may occur. That is, a difference in circumferential speed, which is caused by a difference in diameter between the stiffening rollers B3 and the first conveyance rollers B1, results in a difference of the conveyance amount of the sheet P per unit time. This difference in conveyance amount causes a large amplitude of the corrugation of the sheet P, thus easily causing abnormal sound.

This is especially remarkable in the configuration (specifically, a small-sized image forming apparatus with a comparatively short distance between the stiffening rollers B3 and the curved conveyance path D) where the sheet P is moved to the curved conveyance path D in a state where the corrugation is kept to be comparatively large.

In this respect, Patent Document 1 discloses the following configuration. In a forward rotation as a normal discharging state, the stiffening roller is secured to the conveyance roller to integrally rotate and convey a recording material. In a reverse rotation, the stiffening roller is unlocked with respect to the conveyance roller and driven to rotate by the conveyed recording material.

However, the configuration disclosed in Patent Literature 1 has a complicated structure of the stiffening roller. This increases in cost and has no consideration on the corrugation of the sheet to be conveyed in a forward rotation direction.

Therefore, an object of the present invention is to provide a sheet conveying device that has a simple and low-cost structure, ensures stacking quality of the sheet, and suppresses the occurrence of inconveniences (especially, abnormal sound of the sheet conveyed to a curved conveyance path curved in a conveying direction) related to corrugation of the sheet by a stiffening roller regardless of a rotation direction of a conveyance roller. Another object of the present invention is to provide an image forming apparatus that includes this sheet conveying device.

Solutions to the Problems

The inventors conducted extensive research to achieve the above objects, and discovered the following information. Similarly to the conventional configuration, the configuration where all the individual stiffening rollers applied conveying forces to the sheet caused inconvenience (especially, abnormal sound of the sheet conveyed to the curved conveyance path curved in the conveying direction) related to corrugation of the sheet by the stiffening roller. In contrast, the configuration where all the individual stiffening rollers did not apply conveying forces to the sheet solved the inconvenience related to the corrugation but reduced conveying forces to the sheet. This caused rear end remaining of the sheet and did not ensure stacking quality of the sheet.

The inventors focused on this point, and found the following effects. A configuration where a part of the individual stiffening rollers did not apply a conveying force or apply a reduced conveying force to the sheet ensured a simple and low-cost structure and avoided occurrence of rear end remaining. Therefore, this ensures stacking quality of the sheet, and reduces amplitude of corrugation of the sheet. This reduces occurrence of inconveniences (especially, abnormal sound of the sheet conveyed to the curved conveyance path curved in the conveying direction) related to the corrugation regardless of a rotation direction of the conveyance roller. Thus, the present invention was accomplished.

That is, the present invention provides a sheet conveying device. The sheet conveying device includes a plurality of first conveyance rollers, a plurality of second conveyance rollers, and a stiffening roller. The plurality of first conveyance rollers are disposed coaxially with one another. The plurality of second conveyance rollers face the respective plurality of first conveyance rollers. The plurality of second conveyance rollers are disposed coaxially with one another. The plurality of second conveyance rollers are configured to convey a sheet while sandwiching the sheet between the second conveyance rollers and the first conveyance rollers to be rotated. The stiffening roller is disposed coaxially with either or both of the first and second conveyance rollers. The stiffening roller has a diameter larger than a diameter of either or both of the first and second conveyance rollers. The stiffening roller includes a first stiffening roller and a second stiffening roller. The first stiffening roller applies a conveying force to the sheet. The second stiffening roller applies a smaller conveying force to the sheet than the conveying force to the sheet by the first stiffening roller.

Here, the description about the second stiffening roller where "the sheet conveying force is smaller than the conveying force to the sheet by first stiffening roller" means a concept that also includes a case where a conveying force is not applied to the sheet.

Additionally, the present invention provides an image forming apparatus that includes the sheet conveying device according to the present invention and a curved conveyance path curved in a conveying direction of a sheet. The image forming apparatus is configured to convey a sheet from the sheet conveying device toward the curved conveyance path.

With the present invention, the stiffening roller is configured to include the first stiffening roller and the second stiffening roller. This ensures a simple and low-cost structure. The stiffening roller allows imparting a corrugated shape to the sheet (specifically a recording paper or an original) in the axial direction. Additionally, the stiffening roller includes the first stiffening roller that applies a conveying force to the sheet. This avoids occurrence of rear end remaining of the sheet, thus ensuring stacking quality of the sheet. Furthermore, the stiffening rollers do not have configuration where all the individual stiffening rollers apply conveying forces to the sheet. The stiffening rollers include the second stiffening roller that applies a smaller conveying force to the sheet than a conveying force of the first stiffening roller to the sheet, in addition to the first stiffening roller that applies a conveying force to the sheet. This reduces the difference in conveyance amount of the sheet per unit time by the difference in circumferential speed between the stiffening roller and the conveyance roller, which is disposed coaxially with the stiffening roller, irrespective of the rotation directions of the first and second conveyance rollers, thus reducing amplitude of corrugation of the sheet. This reduces occurrence of inconveniences (especially, abnormal sound of the sheet conveyed to the curved conveyance path curved in the conveying direction, for example, the curved conveyance path in the image forming apparatus according to the present invention) related to the corrugation.

In the present invention, as specific aspects of the first and second stiffening rollers, an aspect (a) and an aspect (b) will be exemplarily described as follows.

That is, as the aspect (a), an exemplary aspect will be described as follows. The first stiffening roller is configured to integrally rotate with a conveyance roller disposed coaxially with the first stiffening roller. The second stiffening roller is configured to freely rotate with respect to a conveyance roller disposed coaxially with the second stiffening roller.

In this aspect (a), the first stiffening roller is configured to integrally rotate with the conveyance roller disposed coaxially with the first stiffening roller. Rotation of the conveyance roller rotates the first stiffening roller. Additionally, the second stiffening roller is configured to freely rotate with respect to the conveyance roller disposed coaxially with the second stiffening roller. The second stiffening roller is in a free state where rotation of the second stiffening roller is not restricted together with the rotation of the conveyance roller even if the conveyance roller rotates. Accordingly, the first stiffening roller provides a conveying force to the sheet while the second stiffening roller does not provide a conveying force to the sheet. This allows reducing the difference in conveyance amount of the sheet per unit time by the difference in circumferential speed between the stiffening roller and the conveyance roller disposed coaxially with the stiffening roller.

Additionally, as the aspect (b), an exemplary aspect will be described as follows. The first stiffening roller and the second stiffening roller are configured to integrally rotate with the respective conveyance rollers disposed coaxially with the first and second stiffening rollers. A friction coefficient of a surface of the second stiffening roller is smaller than a friction coefficient of a surface of the first stiffening roller.

In this aspect (b), the first stiffening roller and the second stiffening roller are configured to integrally rotate with the respective conveyance rollers disposed coaxially with the first and second stiffening rollers. The friction coefficient of the surface of the second stiffening roller is smaller than the friction coefficient of the surface of the first stiffening roller. In view of this, the sheet easily slides on the second stiffening roller compared with the first stiffening roller. This reduces a conveying force to the sheet in the second stiffening roller compared with a conveying force to the sheet in the first stiffening roller. This consequently reduces the difference in conveyance amount of the sheet per unit time by the difference in circumferential speed between the stiffening roller and the conveyance roller disposed coaxially with the stiffening roller. The friction coefficient of the surface of the second stiffening roller may be a friction coefficient that does not provide a conveying force to the sheet.

In the present invention, an exemplary aspect will be described as follows. The stiffening roller and the conveyance roller are disposed symmetrically with respect to the center reference in the axial direction of the conveyance roller. The conveyance roller is disposed coaxially with the stiffening roller.

In this limitation, the stiffening roller and the conveyance roller disposed coaxially with the stiffening roller are disposed symmetrically with respect to the center reference in the axial direction. This applies a conveying force to the sheet symmetrically with respect to the center reference. This allows preventing occurrence of skew (diagonal feed). This aspect is preferred to be used in the configuration for sheet conveyance with the center reference.

In the present invention, an exemplary aspect will be described as follows. The stiffening rollers include the first stiffening roller at the center portion in the axial direction and the second stiffening rollers at both end portions.

In this limitation, the stiffening roller includes the first stiffening roller at the center portion in the axial direction and the second stiffening rollers at both end portions. This reduces occurrence of inconveniences related to corrugation of the sheet while ensuring stable conveyance of the sheet in the center portion in the axial direction.

In the present invention, an exemplary aspect will be described as follows. The first stiffening roller is a stiffening roller positioned closest to the center position in the axial direction among the stiffening rollers.

In this limitation, the first stiffening roller is the stiffening roller positioned closest to the center position in the axial direction among the stiffening rollers. This provides a conveying force near the center position. This allows surely conveying the sheet in a size smaller than the maximum size even in the case where the sheets in a plurality of sizes are used.

In the present invention, an exemplary aspect will be described as follows. A stiffening roller positioned closest to the center position in the axial direction among the stiffening rollers is configured to convey a sheet in a minimum size. The minimum size is usable in an image forming apparatus with this sheet conveying device.

In this limitation, the stiffening roller positioned closest to the center position in the axial direction among the stiffening rollers is configured to convey a sheet in a minimum size. The minimum size is usable in an image forming apparatus with the sheet conveying device. This allows surely conveying the sheet even in the minimum size in the configuration for sheet conveyance with the center reference. In this case, the stiffening roller positioned closest to the center position can be disposed in a position that allows conveying the sheet in the available minimum size.

In the present invention, the stiffening roller may be disposed at a shaft of the conveyance roller disposed coaxially with the stiffening roller or may disposed at the conveyance roller itself.

For example, an exemplary aspect of the stiffening roller will be described as follows. The stiffening roller is disposed in one side end portion of the conveyance roller in the axial direction. The conveyance roller is disposed coaxially with the stiffening roller.

In this limitation, the stiffening roller is disposed in one side end portion of the conveyance roller in the axial direction. The conveyance roller is disposed coaxially with the stiffening roller. Compared with a case where the stiffening roller is distant from the conveyance roller disposed coaxially with the stiffening roller in the axial direction (for example, a case where the stiffening roller is provided at the center between the adjacent conveyance rollers), this provides a large proportion of amplitude to the difference between the diameter of the stiffening roller and the diameter of the conveyance roller even in the case where corrugations of the sheet have the same maximum amplitude. This consequently reduces material cost. Furthermore, this allows providing the stiffening roller and the conveyance roller as one assembly part, thus ensuring reduced assembly processes for the stiffening roller and the conveyance roller.

Advantageous Effects of Invention

As described above, with the present invention, the stiffening roller includes the first stiffening roller and the second stiffening roller. The first stiffening roller applies the conveying force to the sheet. The second stiffening roller applies the conveying force, which is smaller than the conveying force to the sheet by the first stiffening roller, to the sheet. This ensures a simple low-cost structure and stacking quality of the sheet, and suppresses the occurrence of inconveniences (especially, abnormal sound of the sheet conveyed to the curved conveyance path curved in the conveying direction) related to corrugation of the sheet by the stiffening roller regardless of the rotation direction of the conveyance roller.

BRIEF DESCRIPTION OF DRAWINGS

FIG. 4A is a schematic side view of the first stiffening roller portions viewed from the conveying direction, FIG. 4B is a schematic side view of the first stiffening roller portion viewed from an axial direction.

FIG. 5A is a schematic side view of the first stiffening roller portion viewed from the conveying direction, FIG. 5B is a schematic side view of the first stiffening roller portion viewed from the axial direction, FIG. 5C is a schematic side view of the second stiffening roller portion viewed from the conveying direction, and FIG. 5D is a schematic side view of the second stiffening roller portion viewed from the axial direction.

FIG. 6 is a table illustrating positional relationships and sizes of outer diameters of the stiffening rollers by a difference in destination of the image forming apparatus.

FIG. 7 is a table illustrating results of Comparative examples 1 and 2 and the embodiment.

FIG. 8 is a table illustrating results of examination for occurrence of abnormal sound in a reverse conveying path by difference in paper type in Comparative example 1 and the embodiment, (a) is a table illustrating results of respective paper sizes according to Comparative example 1, and (b) is a table illustrating results of respective paper sizes according to the embodiment.

FIG. 9A is a schematic side view illustrating a discharged state of a sheet conveyed to a discharge tray viewed from an axial direction of conveyance rollers, and FIG. 9B is a schematic side view illustrating a conveying state of the sheet viewed from a conveying direction of the sheet.

FIG. 10A is a schematic side view illustrating a discharged state of a sheet conveyed to a discharge tray viewed from an axial direction of conveyance rollers, and FIG. 10B is a schematic side view illustrating a conveying state of the sheet viewed from a conveying direction of the sheet.

DESCRIPTION OF EMBODIMENTS

Hereinafter, embodiments according to the present invention will be described with reference to the accompanying drawings. The embodiments described below are only examples in which the present invention is embodied, and are not intended to limit the technical scope of the present invention.

(Description of an Overall Configuration of an Image Forming Apparatus)

Figure 1:
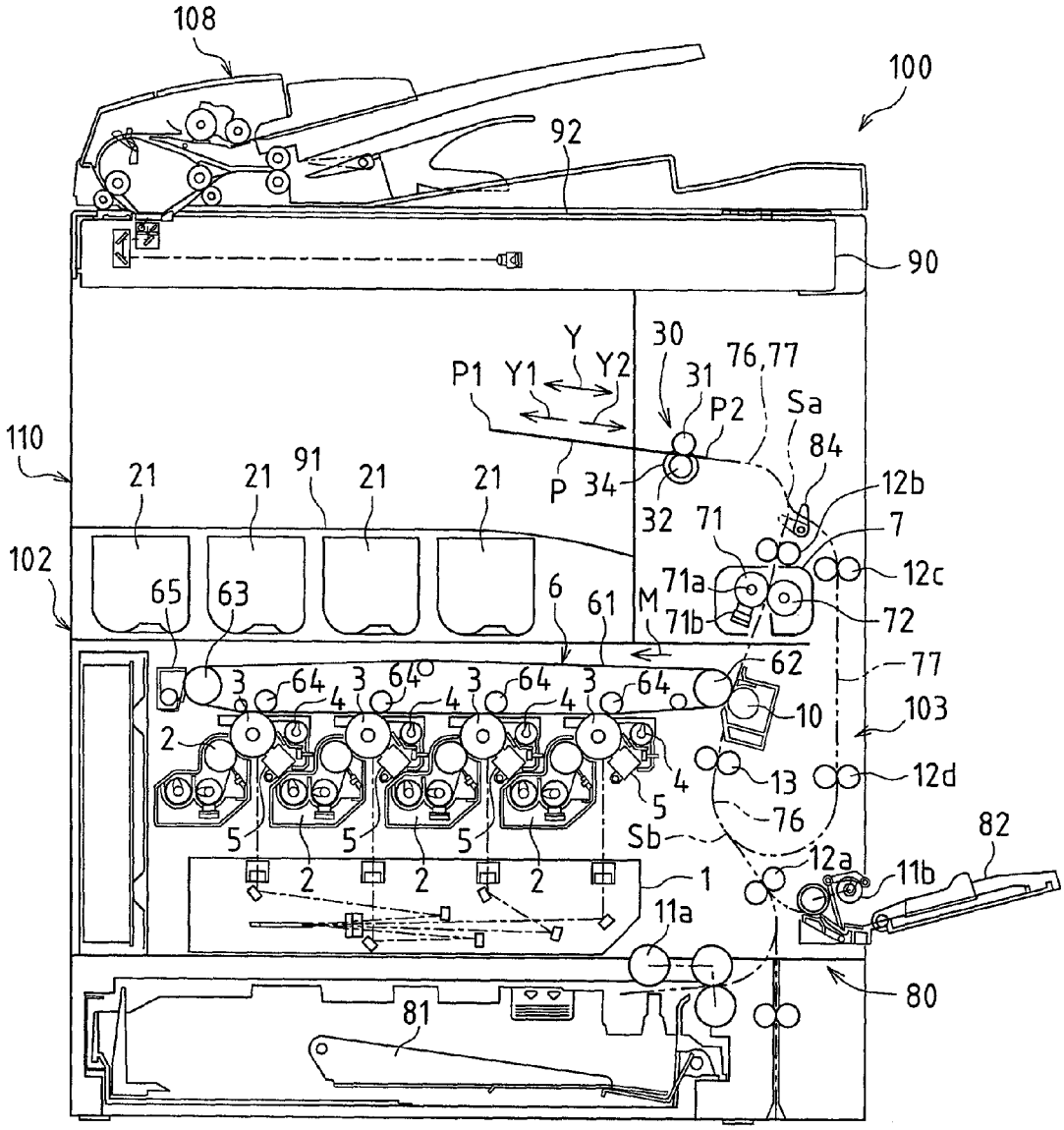
FIG. 1 is a schematic cross-sectional view illustrating an image forming apparatus with a sheet conveying device according to an embodiment of the invention viewed from a front view.

FIG. 1 is a schematic cross-sectional view of an image forming apparatus 100 with a sheet conveying device 30 according to an embodiment of the present invention viewed from a front view.

The image forming apparatus 100 illustrated in FIG. 1 is a color image forming apparatus that forms a multicolor and a single color image on a sheet (hereinafter referred to as a paper) P such as a recording paper corresponding to image data transmitted from outside. The image forming apparatus 100 includes an original reading device 108 and a device main body 110. The device main body 110 includes an image forming portion 102 and a sheet conveying system 103.

The image forming portion 102 includes an exposure unit 1, a plurality of developing units 2, a plurality of photoreceptor drums 3, a plurality of cleaning portions 4, a plurality of chargers 5, an intermediate transfer belt unit 6, a plurality of toner cartridge units 21, and a fixing unit 7.

The sheet conveying system 103 includes a paper feeding unit 80, conveying paths (a main conveying path 76 and a reverse conveying path 77) described later, and a discharge tray 91. The paper feeding unit 80 includes a paper feed tray 81 and a manual paper feed tray 82.

The device main body 110 has an upper portion that includes an original placement plate 92 made of transparent glass on which an original (a sheet) is placed. The original placement plate 92 has a lower portion that includes an optical unit 90 for reading the original. The original placement plate 92 has an original reading device 108 at an upper side. The original reading device 108 automatically conveys the original on the original placement plate 92. The original reading device 108 is turnably mounted to open its front side with respect to the device main body 110. Opening an upper portion of the original placement plate 92 allows manually placing the original.

The original reading device 108 allows reading an automatically conveyed original, or an original placed on the original placement plate 92. An overall image of the original, which is read by the original reading device 108, is transmitted to the device main body 110 of the image forming apparatus 100 as image data. An image formed by the device main body 110 based on the image data is recorded on a paper P.

The image data handled in the image forming apparatus 100 corresponds to a color image with a plurality of colors (here, respective colors of black (K), cyan (C), magenta (M), and yellow (Y)). Accordingly, a plurality (here, four of black, cyan, magenta, and yellow) of developing units 2, photoreceptor drums 3, cleaning portions 4, chargers 5, and toner cartridge units 21 are set to form multiple kinds (here, four kinds) of images corresponding to the respective colors. These members constitute a plurality (here, four) of image stations.

The chargers 5 are charging units to uniformly charge surfaces of the photoreceptor drums 3 to a predetermined potential. The chargers 5 may employ a contact type charger, such as a roller type charger and a brush type charger, as well as the type of the charger illustrated in FIG. 1.

The exposure unit 1 is configured as a laser scanning unit (LSU) that includes a laser emitting portion and a reflecting mirror. The exposure unit 1 includes a polygon mirror and an optical element such as a lens and a mirror. The polygon mirror scans a laser beam. The optical element guides the laser light, which is reflected by the polygon mirror, to the photoreceptor drums 3. The exposure unit 1 can employ, in addition to this method, a method using a write head where light emitting elements, such as electroluminescence (EL) and a light-emitting diode (LED), are arranged in an array.

The exposure unit 1 exposes the respective charged photoreceptor drums 3 corresponding to the input image data in order to form electrostatic latent images, which correspond to the image data, on respective surfaces of the photoreceptor drums 3.

The toner cartridge units 21 are units that house toners. The toners are supplied to developer tanks of the developing units 2. In the device main body 110 of the image forming apparatus 100, toners supplied from the toner cartridge units 21 to the developer tanks of the developing units 2 are controlled such that toner concentration of the developer in the developer tank is constant.

The developing units 2 visualize electrostatic latent images formed on the respective photoreceptor drums 3 using toners of four colors (Y, M, C, and K). The cleaning portions 4 remove and recover the toners remaining on the surfaces of the photoreceptor drums 3 after development and transfer of the image.

The intermediate transfer belt unit 6 above the photoreceptor drums 3 includes an intermediate transfer belt 61, an intermediate transfer belt drive roller 62, an intermediate transfer belt driven roller 63, a plurality of intermediate transfer rollers 64, and an intermediate transfer belt cleaning unit 65. The intermediate transfer belt 61 operates as an intermediate transfer body.

Four intermediate transfer rollers 64 are disposed corresponding to the respective colors of Y, M, C, and K. The intermediate transfer belt drive roller 62 stretches the intermediate transfer belt 61 with the intermediate transfer belt driven roller 63 and the intermediate transfer rollers 64. The intermediate transfer belt drive roller 62 is rotatably driven so as to revolve the intermediate transfer belt 61 in a movement direction (in an arrow M direction in FIG. 1). In accordance with this revolution, the driven roller 63 and the intermediate transfer rollers 64 are driven to rotate.

A transfer bias voltage is applied to each of the intermediate transfer rollers 64 to transfer toner images formed on the photoreceptor drums 3 onto the intermediate transfer belt 61.

The intermediate transfer belt 61 is disposed in contact with the respective photoreceptor drums 3. The intermediate transfer belt 61 has a surface on which toner images of the respective colors, which are formed on the photoreceptor drums 3, are sequentially transferred to be overlaid. This forms a color toner image (multi-color toner image) on the surface of the intermediate transfer belt 61. The intermediate transfer belt 61 is, for example, an endless belt using a film with a thickness of about 100 μm to 150 μm.

Transferring the toner images from the photoreceptor drums 3 to the intermediate transfer belt 61 is performed by the intermediate transfer rollers 64 in contact with a back side of the intermediate transfer belt 61. High transfer bias voltages (high voltages with reversed polarity (+) of charged polarity (−) of the toners) are applied to the intermediate transfer rollers 64 to transfer the toner images. The intermediate transfer rollers 64 are rollers that each includes a metal (such as stainless steel) shaft with a diameter of 8 mm to 10 mm as a base and a surface covered with a conductive elastic material (for example, a resin material such as ethylene-propylene-diene rubber (EPDM) and foamed urethane). With this conductive elastic material, the intermediate transfer rollers 64 function as transfer electrodes that uniformly apply a high voltage to the intermediate transfer belt 61. While in this embodiment the transfer electrode employs the roller-shaped transfer electrode, a brush electrode and a similar electrode may also be used as another type of transfer electrode.

As described above, the toner images visualized on the respective photoreceptor drums 3 corresponding to the respective color phases are overlaid on the intermediate transfer belt 61. The toner image, which is overlaid on the intermediate transfer belt 61, is transferred onto the paper P by a transfer roller 10 in accordance with the revolution of the intermediate transfer belt 61. The transfer roller 10 constitutes a secondary transfer mechanism disposed in contact with between the paper P and the intermediate transfer belt 61. The configuration of the secondary transfer mechanism is not limited to the transfer roller. The secondary transfer mechanism may employ a transfer configuration of a corona charger, a transfer belt, and a similar member.

At this time, a voltage (a high voltage with reversed polarity (+) of charged polarity (−) of the toner) is applied to the transfer roller 10 in order to transfer the toner to the paper P in a state where a transfer nip is formed between the transfer roller 10 and the intermediate transfer belt 61. The transfer roller 10 and the intermediate transfer belt drive roller 62 are brought into pressure contact with each other. This forms a transfer nip between the transfer roller 10 and the intermediate transfer belt 61. In order to obtain the transfer nip steadily, either one of the transfer roller 10 and the intermediate transfer belt drive roller 62 is a hard roller made of a hard material (such as metal) while the other is an elastic roller made of a soft material (a resin material such as elastic rubber and foamable resin).

When the transfer roller 10 transfers the toner image from the intermediate transfer belt 61 onto the paper P, the toner may remain on the intermediate transfer belt 61 without being transferred onto the paper P. The toner remaining on the intermediate transfer belt 61 may cause color mixture of the toners in the subsequent process. In view of this, the toner remaining on the intermediate transfer belt 61 is removed and recovered by the intermediate transfer belt cleaning unit 65. Specifically, the intermediate transfer belt cleaning unit 65 includes a cleaning member (such as a cleaning blade) in contact with the intermediate transfer belt 61. The driven roller 63 supports the intermediate transfer belt 61 from the inside (a back side). The cleaning member is in contact with the intermediate transfer belt 61 so as to press the intermediate transfer belt 61 toward the driven roller 63 from the outside.

The paper feed tray 81 is a tray that preliminarily houses the paper P on which an image is formed (printed). The paper feed tray 81 is disposed below the exposure unit 1 in the device main body 110. On the manual paper feed tray 82, the paper P where an image is formed (printed) is placed. The discharge tray 91 is disposed on the upper side of the image forming portion 102 in the device main body 110. The discharge tray 91 accumulates the paper P on which an image has been formed (printed) face-down.

The device main body 110 includes a main conveying path 76. The main conveying path 76 feeds the paper P, which is fed from the paper feed tray 81 and the manual paper feed tray 82, to the discharge tray 91 through the transfer roller 10 and the fixing unit 7. At the proximity of the main conveying path 76, pickup rollers 11*a* and 11*b*, a plurality of (here, first and second) conveyance rollers 12*a* and 12*b*, a registration roller 13, the transfer roller 10, and a heat roller 71 and a pressing roller 72 in the fixing unit 7 are disposed. At the proximity of the reverse conveying path 77, a plurality of (here, third and fourth) conveyance rollers 12*c* and 12*d* are disposed.

The first to fourth conveyance rollers 12*a* to 12*d* are small rollers for accelerating and assisting conveyance of the paper P. The pickup roller 11*a* is disposed at the proximity of the paper feed tray 81 at a paper feeding side. The pickup roller

11*a* picks up the paper P sheet by sheet from the paper feed tray 81 to feed the paper P to the main conveying path 76. Similarly, the pickup roller 11*b* is disposed at the proximity of the manual paper feed tray 82 at a paper feeding side. The pickup roller 11*b* picks up the paper P sheet by sheet from the manual paper feed tray 82 to supply the paper P to the main conveying path 76.

The registration roller 13 once holds the paper P that is being conveyed on the main conveying path 76. Then, the registration roller 13 conveys the paper P to the transfer roller 10 at a timing when a leading end of the toner image on the intermediate transfer belt 16 is aligned with a downstream side end (hereinafter referred to as a leading end) P1 of the paper P at one side Y1 in the conveying direction Y.

The fixing unit 7 fixes an unfixed toner image to the paper P. The fixing unit 7 includes the heat roller 71 and the pressing roller 72 that operate as fixing rollers. The heat roller 71 is rotatably driven to convey the paper P while sandwiching the paper P with the pressing roller 72 that rotates in accordance with the rotation of the heat roller 71. The heat roller 71 is heated by a heater 71*a* disposed inside, and is maintained at a predetermined fixing temperature based on a signal from a temperature sensor 71*b*. The heat roller 71, which is heated by the heater 71*a*, performs thermo-compression bonding of a multicolor toner image, which is transferred to the paper P, on the paper P with the pressing roller 72. This melts, mixes, and presses to make a contact with the multicolor toner image to heat-fix the multicolor toner image to the paper P.

(Conveying Path)

Figure 2:
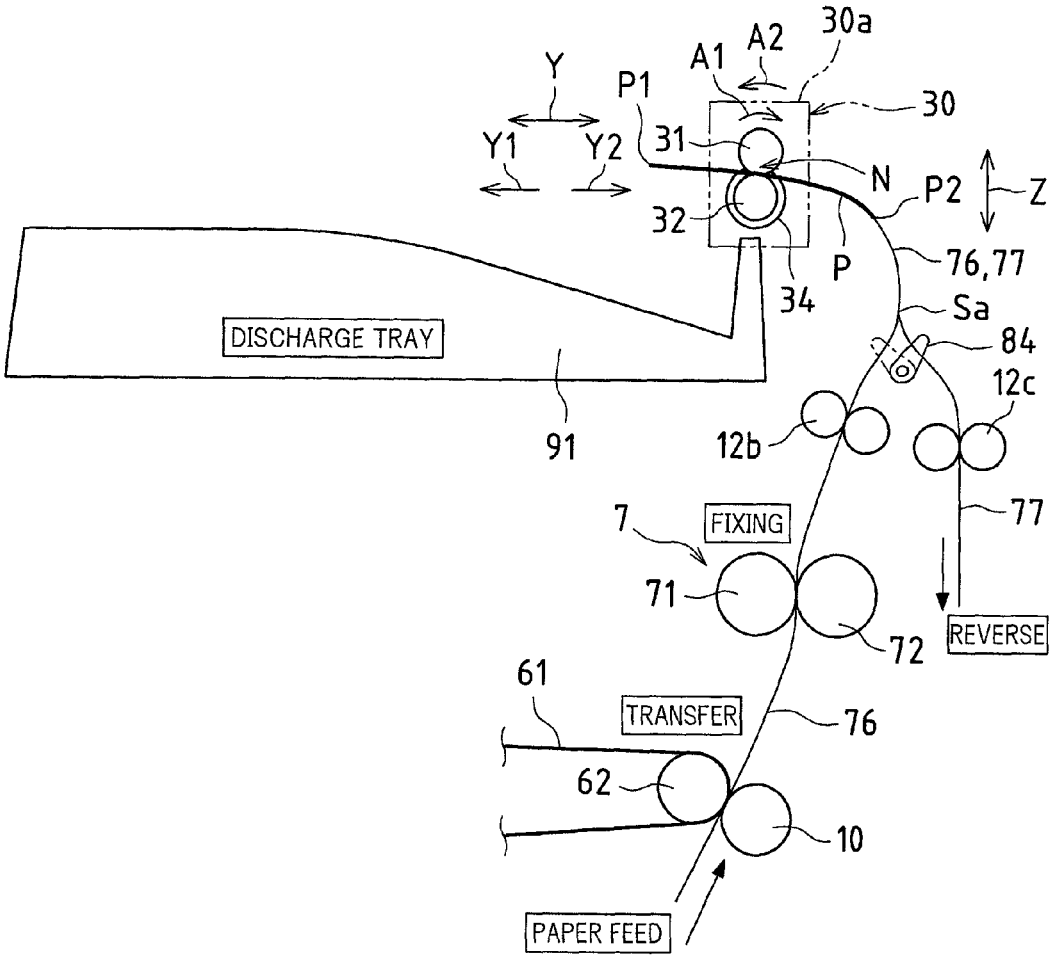
FIG. 2 is a schematic cross-sectional view illustrating conveying paths in the image forming apparatus illustrated in FIG. 1.

FIG. 2 is a schematic cross-sectional view illustrating conveying paths 76 and 77 in the image forming apparatus 100 illustrated in FIG. 1.

As illustrated in FIG. 1 and FIG. 2, the image forming apparatus 100 includes, as described above, the main conveying path 76 and the reverse conveying path 77 as the conveying paths on which the paper P is conveyed. The image forming apparatus 100 has a configuration where the sheet is conveyed at the center reference. The reverse conveying path 77 constitutes a curved conveyance path curved in the conveying direction Y.

The main conveying path 76 is a conveying path for conveyance of the paper P between the paper feeding unit 80 and the sheet conveying device 30.

The reverse conveying path 77 is a conveying path for conveyance of the paper P conveyed to the other side Y2 in the opposite direction of one side Y1 in the conveying direction Y. The reverse conveying path 77 goes through a part of the main conveying path 76 from the sheet conveying device 30 to a bifurcating portion Sa between the fixing unit 7 and the sheet conveying device 30. The reverse conveying path 77 is coupled to a coupling portion Sb (see FIG. 1), which is coupled to the main conveying path 76 between the image forming portion 102 and the paper feeding unit 80. Accordingly, the main conveying path 76 and the reverse conveying path 77 share a conveying path between the sheet conveying device 30 and the bifurcating portion Sa.

The bifurcating portion Sa includes a bifurcating claw 84. The bifurcating claw 84 is configured to take a first posture (a posture illustrated by a solid line in FIG. 2) and a second posture (a posture illustrated by a two-dot chain line in FIG. 2). The bifurcating claw 84 in the first posture guides the paper P from the fixing unit 7 toward the sheet conveying device 30. The bifurcating claw 84 in the second posture guides the paper P to the reverse conveying path 77 side. In this case, the paper P is conveyed to the other side Y2 in the opposite direction of one side Y1 in the conveying direction Y by reverse rotation (rotation illustrated by an arrow A2 direction in FIG. 2) of conveyance rollers 31 and 32 described later in the sheet conveying device 30.

The image forming apparatus 100 thus configured conveys the paper P fed from each of the paper feed trays 81 and 82 to the registration roller 13 using the first conveyance roller 12*a* disposed along the main conveying path 76. The paper P is conveyed by the transfer roller 10 at a timing when the leading end P1 of the paper P is aligned with the leading end of the toner image on the intermediate transfer belt 61. Then, the toner image is transferred onto the paper P. Then, the paper P passes through the fixing unit 7 to melt and fix the unfixed toner on the paper P with heat.

Then, in the case where the bifurcating claw 84 is set to the first posture to print an image on one side of the paper P, the paper P from the fixing unit 7 is conveyed to the conveyance rollers 31 and 32, which rotates forward (rotate in an arrow A1 direction in FIG. 2), via the second conveyance roller 12*b* and then discharged to the discharge tray 91.

In the case where the paper P is printed on both sides, the leading end P1 side of the paper P, which has passed the fixing unit 7, is once conveyed to the outside. An upperstream side end (hereinafter referred to as a rear end) P2 of the paper P at one side Y1 in the conveying direction Y passes through the bifurcating portion Sa. Subsequently, the bifurcating claw 84 is set to the second posture and the conveyance rollers 31 and 32 are reversely rotated. This conveys (switch backs) the paper P to the other side Y2 in the conveying direction Y. The paper P is conveyed to the coupling portion Sb along the reverse conveying path 77 by the third and fourth conveyance roller 12*c* and 12*d* while front and back sides of the paper P are reversed. Subsequently, the paper P, which is conveyed to the transfer nip through the registration roller 13, is printed on the back side. Then the paper P is conveyed and discharged to the discharge tray 91 by the conveyance rollers 31 and 32 that rotate forward.

(Sheet Conveying Device)

Figure 3:
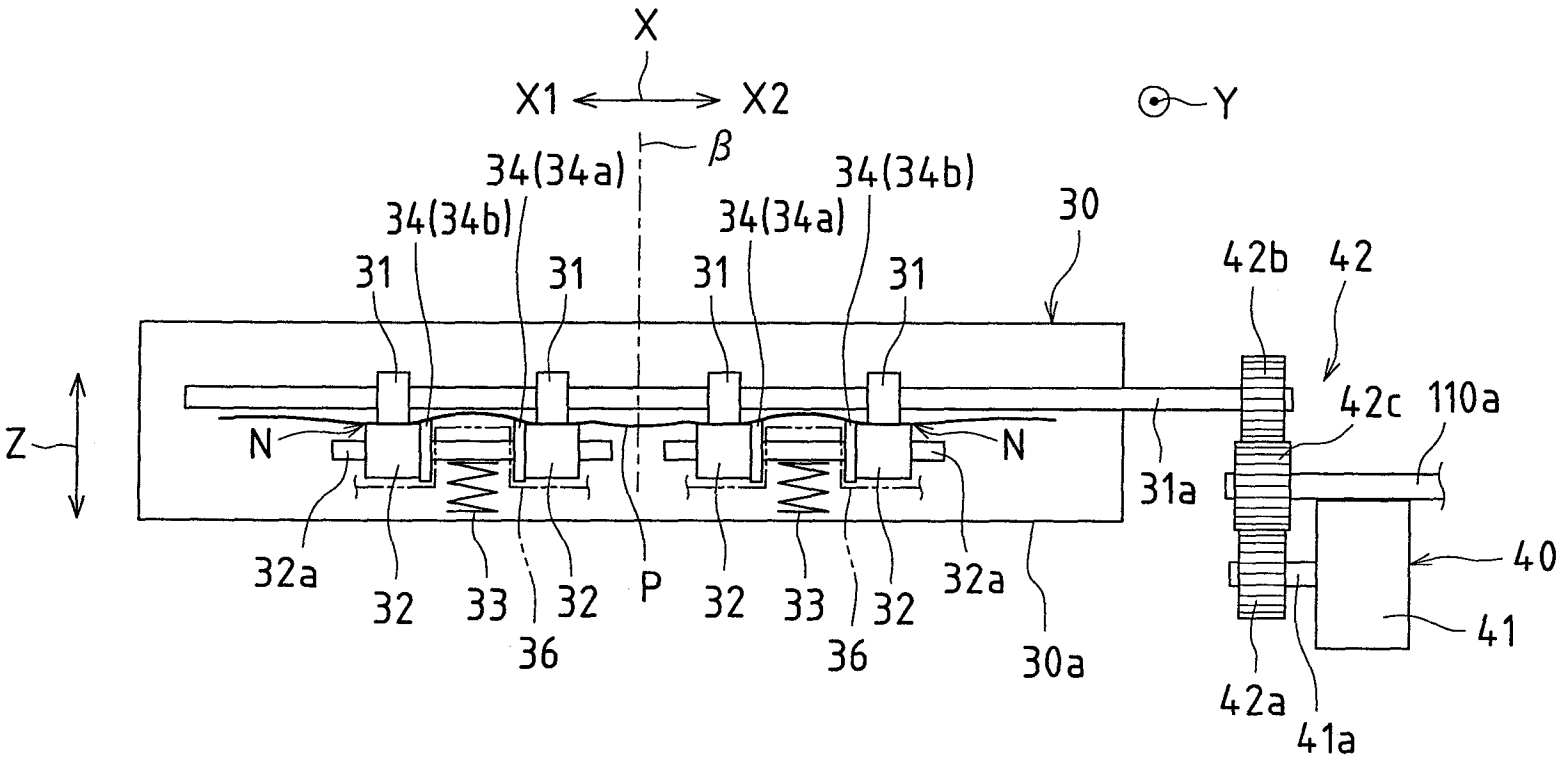
FIG. 3 is a schematic side view of the sheet conveying device in the image forming apparatus illustrated in FIG. 1 viewed from a conveying direction of a paper.

FIG. 3 is a schematic side view of the sheet conveying device 30 in the image forming apparatus 100 illustrated in FIG. 1 viewed from the conveying direction Y of the paper P.

As illustrated in FIG. 2 and FIG. 3, the image forming apparatus 100 according to the embodiment includes the sheet conveying device 30, which conveys the paper P, and the rotation driving portion 40.

The sheet conveying device 30 includes a plurality (here, four) of first discharging rollers (exemplary first conveyance rollers) 31 and a plurality (here, four) of second discharging rollers (exemplary second conveyance rollers) 32. The first discharging rollers 31 have the same diameter, and are disposed coaxially with one another. The second discharging rollers 32 have the same diameter, and are disposed coaxially with one another facing the respective first discharging rollers 31. The sheet conveying device 30 conveys the paper P while sandwiching the paper P between the first discharging rollers (drive rollers) 31, which are rotatably driven, and the second discharging rollers (driven rollers) 32, which are driven in association with the rotation of the first discharging rollers 31. Specifically, the sheet conveying device 30 conveys the paper P toward the discharge tray 91 when the first and the second discharging rollers 31 and 32 rotate forward. On the other hand, when the first and the second discharging rollers 31 and 32 rotate reversely, the sheet conveying device 30 conveys the paper P toward the reverse conveying path 77.

The sheet conveying device 30 further includes the drive roller shaft 31*a* and the driven roller shaft 32*a*. The first discharging rollers 31 are secured to the drive roller shaft 31*a*. The second discharging rollers 32 are secured the driven roller shaft 32*a* while facing the first discharging rollers 31.

The sheet conveying device 30 further includes a biasing member (here, coil spring) 33 that biases the second discharging rollers 32 toward the first discharging rollers 31.

The first and second discharging rollers 31 and 32 and the biasing member 33 are disposed at the main body frame 30*a* of the sheet conveying device 30. One end portion of the drive roller shaft 31*a*, where the first discharging rollers 31 are disposed, is protruded outside in the axial direction (illustrated by an arrow X in FIG. 3) from the main body frame 30*a* of the sheet conveying device 30.

The drive roller shaft 31*a* here is a single member, and is disposed pivotally around an axis line with respect to the main body frame 30*a* of the sheet conveying device 30.

Here, a plurality (here, two) of driven roller shaft 32*a* are arranged along the axial direction X, to which a plurality (here, two) of second discharging rollers 32 are each secured. The driven roller shaft 32*a* is disposed pivotally around the axis line with respect to the main body frame 30*a* of the sheet conveying device 30 and movable back and forth along the vertical direction (an arrow Z direction in the drawing) such that the second discharging rollers 32 face the respective first discharging rollers 31. The sheet conveying device 30 conveys the paper P while the paper P is sandwiched in nip portions N between the first discharging rollers 31 and the second discharging rollers 32 in a state where the paper P is pushed by the second discharging rollers 32.

Specifically, the biasing member 33 biases the second discharging rollers 32 toward the first discharging rollers 31. Here, the biasing member 33 is disposed between the second discharging rollers 32 and between positions on the opposite side of the first discharging rollers 31 of the main body frame 30*a* in the sheet conveying device 30. Pressing forces of the second discharging rollers 32 to the first discharging rollers 31 by the biasing members 33 are pressures that allow properly conveying the paper P.

The sheet conveying device 30 further includes a plurality (here, four) of stiffening rollers 34. The stiffening rollers 34 are disposed coaxially with at least one discharging roller (here, the second discharging rollers 32) among the first and second discharging rollers 31 and 32. The stiffening rollers 34 have diameters larger than diameters of the second discharging rollers 32. The stiffening rollers 34 may be disposed coaxially with one of the first and second discharging rollers 31 and 32, or may be disposed coaxially with both the first and second discharging rollers 31 and 32. In the case where the stiffening rollers 34 are disposed at both the first and second discharging rollers 31 and 32, the stiffening rollers 34 at the first discharging rollers 31 side and the stiffening rollers 34 at the second discharging rollers 32 side are disposed not to overlap one another in the axial direction X.

In view of this, the sheet conveying device 30 allows the stiffening rollers 34 to impart a corrugated shape in the axial direction X to the paper P and stiffen the paper P when conveying the paper P. This prevents the leading end P1 of the paper P from being weighed down early, prevents the rear end remaining of the paper P, and prevents the fixed curl of the sheet P.

Specifically, the stiffening rollers 34 are disposed at an end portion at one side X1 or an end portion at the other side X2 of the second discharging rollers 32 in the axial direction X. The stiffening rollers 34 may be disposed at the driven roller shaft 32*a*.

Here, one stiffening roller 34 may be disposed at every or every a plurality of individual rollers 32 in the second discharging rollers 32. A plurality of stiffening rollers 34 may be disposed at every or every a plurality of the individual rollers 32 in the second discharging rollers 32. The configurations thus arranged may be combined. In this embodiment, the two stiffening rollers 34 are disposed at each of the two places between the two rollers 32 and 32 at both ends and the other two rollers 32 and 32 at the inner side of the rollers 32 and 32 at both ends.

The rotation driving portion 40 rotatably drives the drive roller shaft 31*a* where the first discharging rollers 31 are disposed. The rotation driving portion 40 includes a conveyance driving motor 41 (here, a stepping motor) and a drive transmission mechanism 42, which transmits rotation drive from the conveyance driving motor 41 to the drive roller shaft 31*a*.

The conveyance driving motor 41 is disposed at the device main body 110 where the rotating shaft 41*a* is along the axial direction X.

The drive transmission mechanism 42 includes, here, a gear train where a plurality of gears are lined up, which includes a drive gear 42*a*, a roller gear 42*b*, and an intermediate gear 42*c*.

The drive gear 42*a* is coupled to the rotating shaft 41*a* of the conveyance driving motor 41. The roller gear 42*b* is coupled to an end portion, which protrudes outward in the axial direction X from the main body frame 30*a* of the sheet conveying device 30, of the drive roller shaft 31*a*. The intermediate gear 42*c* is rotatably supported by the rotating shaft 110*a*, which is secured to the device main body 110. The intermediate gear 42*c* is meshed with the drive gear 42*a* and the roller gear 42*b*.

The conveyance driving motor 41 is electrically coupled to an output system of a controller (not shown) to obtain a drive signal (ON signal) or a drive stop signal (OFF signal) from the controller. Transmitting a rotation command signal, which commands a rotation direction, to the conveyance driving motor 41 drives the conveyance driving motor 41. This rotatably drives the first discharging rollers 31 in one direction A1 (one side Y1 in the conveying direction Y, see FIG. 2) or the other direction A2 (the other side Y2 in the conveying direction Y, see FIG. 2).

In the sheet conveying device 30 as described above, when the paper P, which is switch backed, is guided to the reverse conveying path 77 (see FIG. 2), the paper P corrugated by the stiffening rollers 34 in the axial direction X is forcibly curved along the reverse conveying path 77 curved in the conveying direction Y. This restores the paper P from the corrugated state to the prior state. At this time, the stiffening rollers 34 and the second discharging rollers 32 have different circumferential speeds that cause a difference in conveyance amount of the paper P per unit time. This difference in conveyance amount causes large amplitude of the corrugation of the sheet P, thus easily causing abnormal sound. In this embodiment, the stiffening rollers 34 include the first stiffening rollers 34*a*, which apply conveying forces to the paper P, and the second stiffening rollers 34*b*, which apply smaller conveying forces to the paper P than the conveying forces of the first stiffening rollers 34*a* to the paper P (including a case without applying the conveying forces to the paper P). This results in the following configurations of a first embodiment and a second embodiment.

First Embodiment

In the first embodiment, the first stiffening rollers 34*a* are configured to rotate integrally with the two second discharging rollers 32 at the inner side in the axial direction X. The second stiffening rollers 34*b* are disposed pivotally around the axis line with respect to the two second discharging rollers 32 outside in the axial direction X.

Figure 4A:
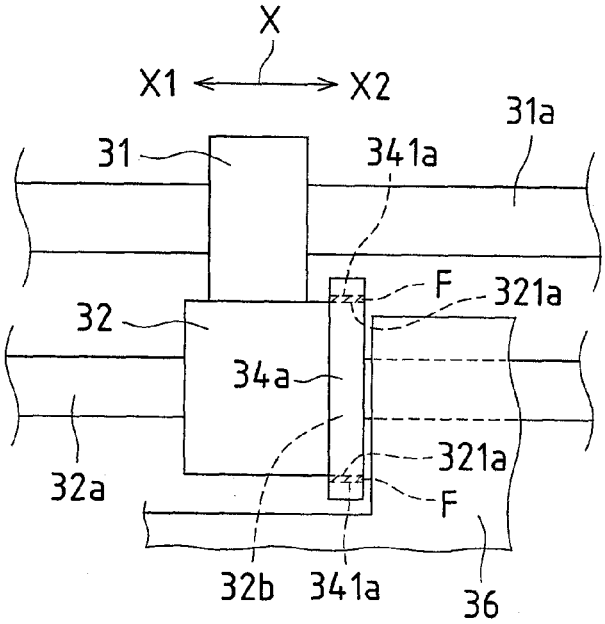
FIGS. 4A and 4B are schematic configuration views of first and second stiffening rollers and their peripheral portions according to the first embodiment.
Figure 4B:
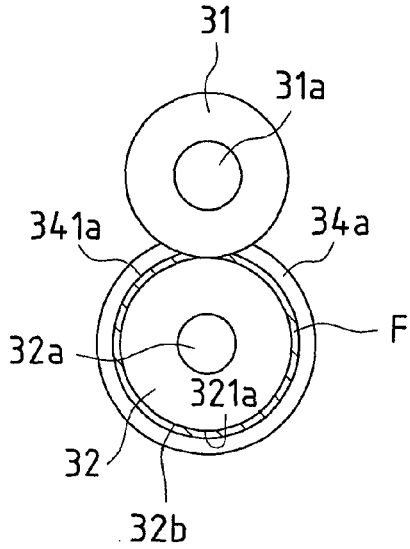
Figure 4C:
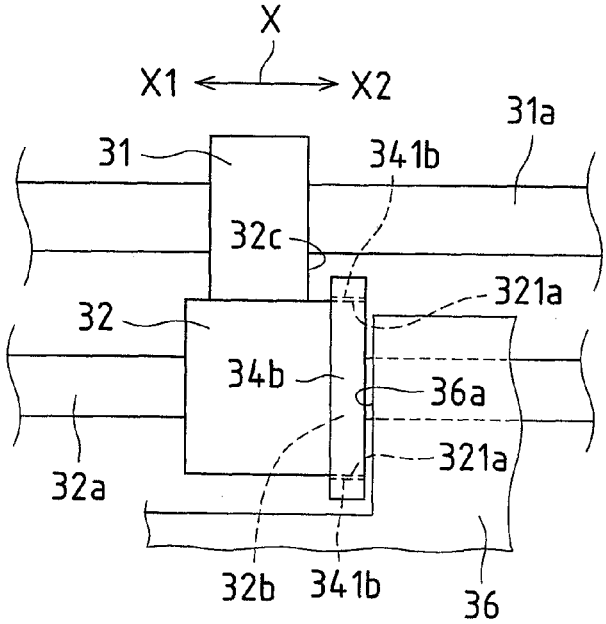
FIG. 4C is a schematic side view of the second stiffening roller portion viewed from the conveying direction.
Figure 4D:
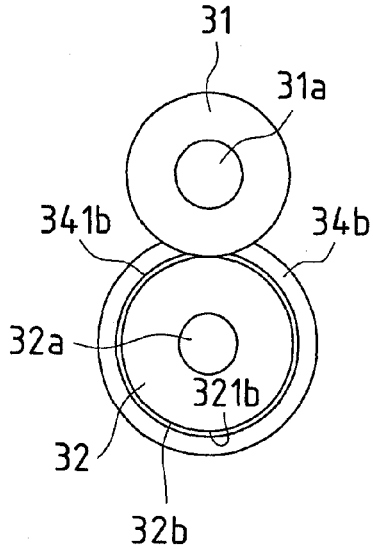
FIG. 4D is a schematic side view of the second stiffening roller portion viewed from the axial direction.

FIGS. 4A and 4B include schematic configuration views of first and second stiffening rollers 34*a* and 34*b* and their peripheral portions according to the first embodiment. FIG. 4A illustrates a schematic side view of the first stiffening roller 34*a* portion viewed from the conveying direction Y. FIG. 4B illustrates a schematic side view of the first stiffening roller 34*a* portion viewed from an axial direction X. FIG. 4C illustrates a schematic side view of the second stiffening roller 34*b* portion viewed from the conveying direction Y. FIG. 4D illustrates a schematic side view of the second stiffening roller 34*b* portion viewed from the axial direction X. FIG. 4A and FIG. 4B illustrate a portion of the two first stiffening rollers 34*a*, which are illustrated in FIG. 3, represented by a portion of the first stiffening roller 34*a* on the right side. FIG. 4C and FIG. 4D illustrate the two second stiffening rollers 34*b*, which are illustrated in FIG. 3, represented by a portion of the second stiffening roller 34*b* on the left side. The same applies to FIGS. 5A to 5D described below.

As illustrated in FIGS. 4A to 4D, the second discharging rollers 32 include the stiffening roller installation portion 32*b* in one side end portion at one side X1 or the other side X2 in the axial direction X.

As illustrated in FIG. 4A and FIG. 4B, the first stiffening rollers 34*a* are formed in a ring shape with the same outer diameter. The ring shape has an inner diameter approximately the same as an outer diameter of the stiffening roller installation portions 32*b* of the second discharging rollers 32. The first stiffening rollers 34*a* each include an inner peripheral surface 341*a* that is secured to an outer peripheral surface 321*a* of the stiffening roller installation portion 32*b* of the second discharging rollers 32 with an adhesive F.

As illustrated in FIG. 4C and FIG. 4D, the second stiffening rollers 34*b* each have a ring shape that has the same outer diameter as the outer diameter of the first stiffening rollers 34*a* and approximately the same inner diameter as the outer diameter of the stiffening roller installation portions 32*b* in the second discharging rollers 32. The second discharging rollers 32 are inserted into the second stiffening rollers 34*b* such that an inner peripheral surface 341*b* of the second stiffening rollers 34*b* slides on the outer peripheral surface 321*a* of the stiffening roller installation portion 32*b* in the second discharging rollers 32.

The main body frame 30*a* of the sheet conveying device 30 includes a cover member 36 that covers the driven roller shaft 32*a* (see FIG. 4C). This provides a configuration with a surface 32*c* that faces the second stiffening roller 34*b* in the first discharging rollers 31 and a surface 36*a* that faces the second stiffening roller 34*b* in the cover member 36. This configuration restricts movements of the second stiffening rollers 34*b* to one side X1 and the other side X2 in the axial direction X, thus preventing the second stiffening rollers 34*b* from dropping from the second discharging rollers 32.

In order to reduce the strain (for example, occurrence of scratching and similar strain) on the paper P when a corrugated shape is imparted to the paper P, the first and second stiffening rollers 34*a* and 34*b* may be constituted of elastic members such as foamable resin.

The foamable resin may employ a material such as polyurethane (specifically, urethane sponge (PORON LE-20 produced by INOAC CORPORATION), silicone rubber, ethylene propylene rubber (EPDM). The first and second discharging rollers 31 and 32 may employ, for example, a resin such as polyacetal (POM) that is excellent in strength and impact resistance.

Second Embodiment

In the second embodiment, the first stiffening rollers 34*a* and the second stiffening rollers 34*b* are each configured to integrally rotate with the second discharging rollers 32. The second stiffening rollers 34*b* includes a surface with a smaller friction coefficient than a friction coefficient of a surface of the first stiffening rollers 34*a*.

Figure 5A:
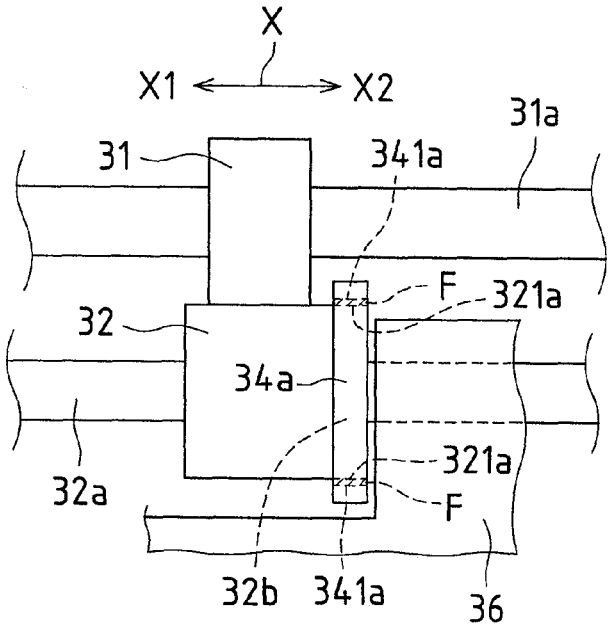
FIGS. 5A to 5D are schematic configuration views of the first and second stiffening rollers and their peripheral portions according to the second embodiment.
Figure 5B:
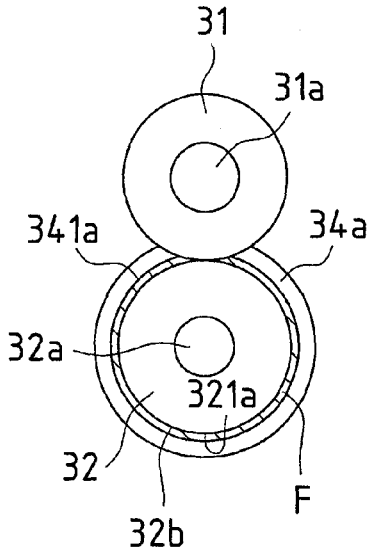
Figure 5C:
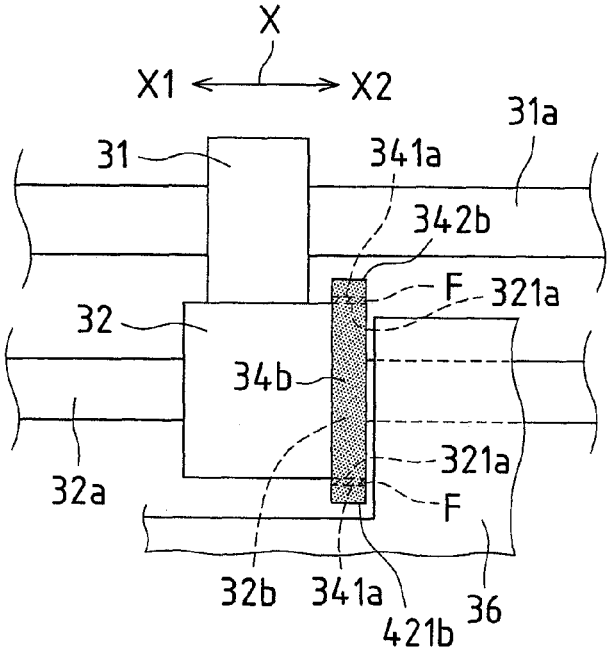
Figure 5D:
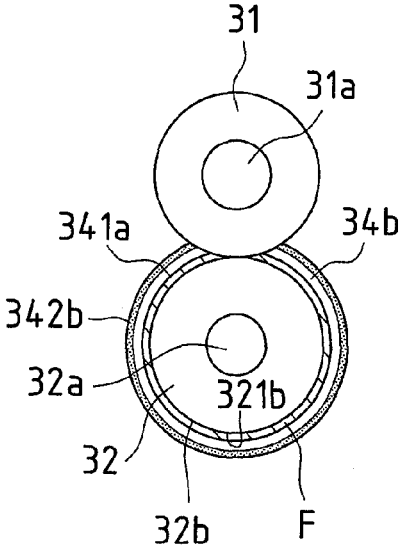
Figure 9A:
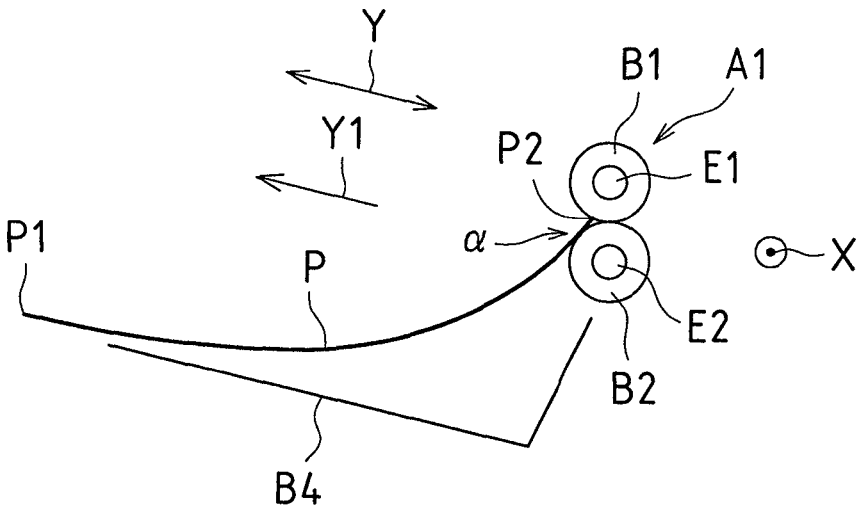
FIGS. 9A and 9B are explanatory views illustrating an exemplary conventional sheet conveying device that degrades stacking quality.
Figure 9B:
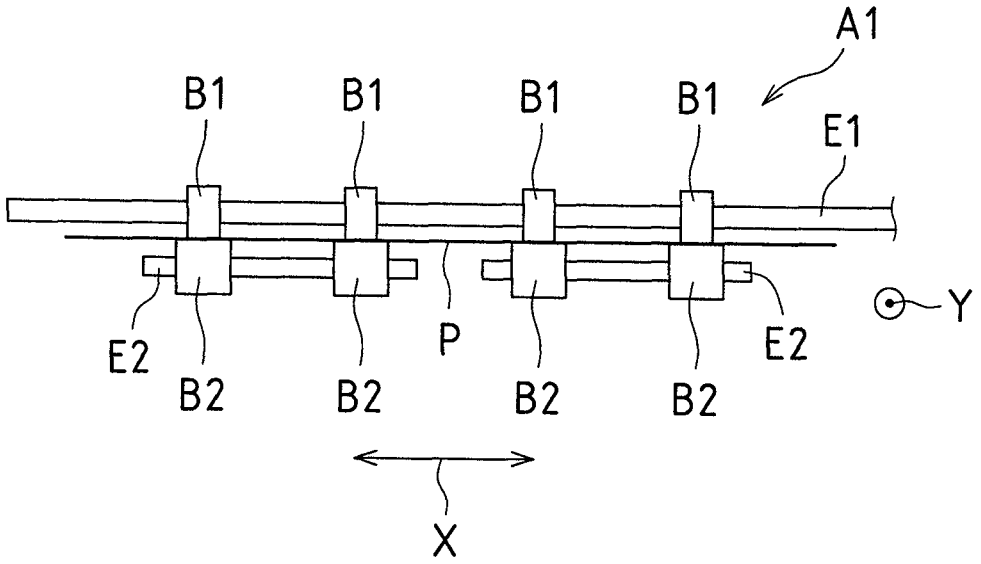
Figure 10A:
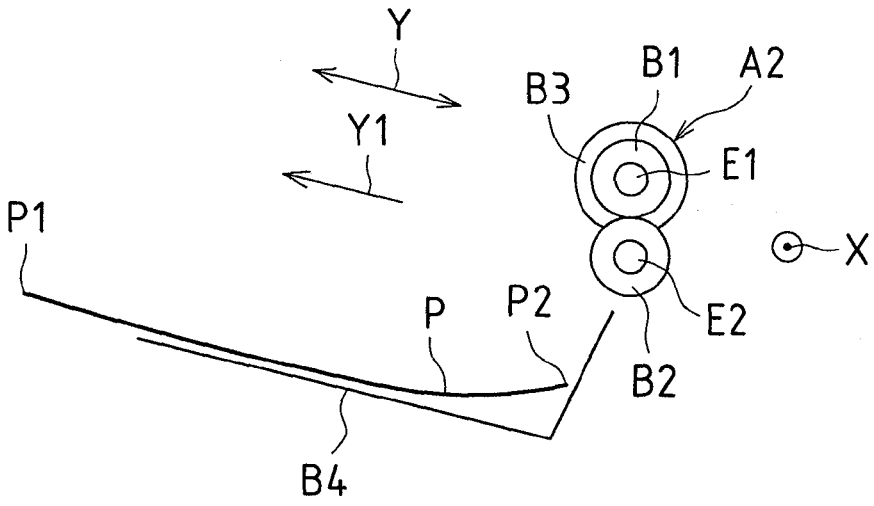
FIGS. 10A and 10B are explanatory views illustrating an exemplary conventional sheet conveying device with the stiffening rollers.
Figure 10B:
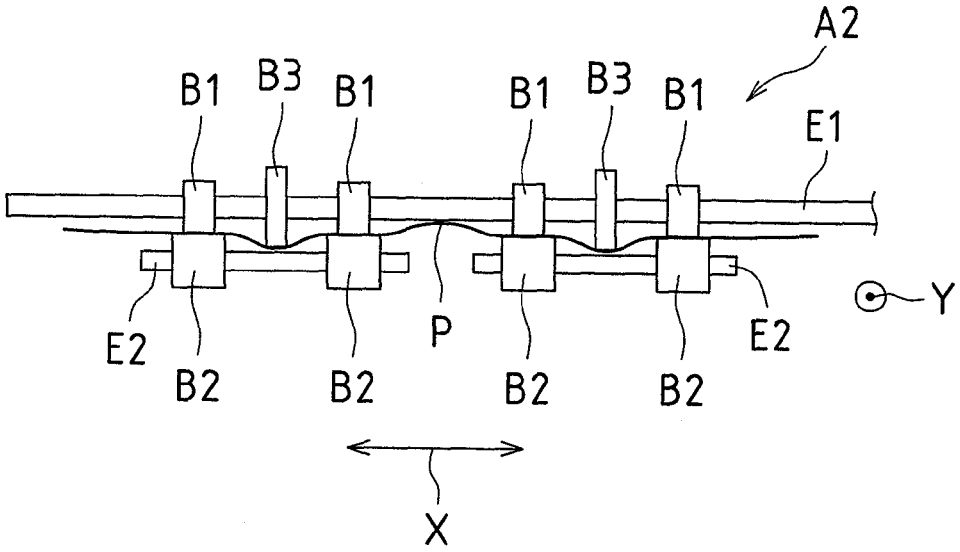
Figure 11:
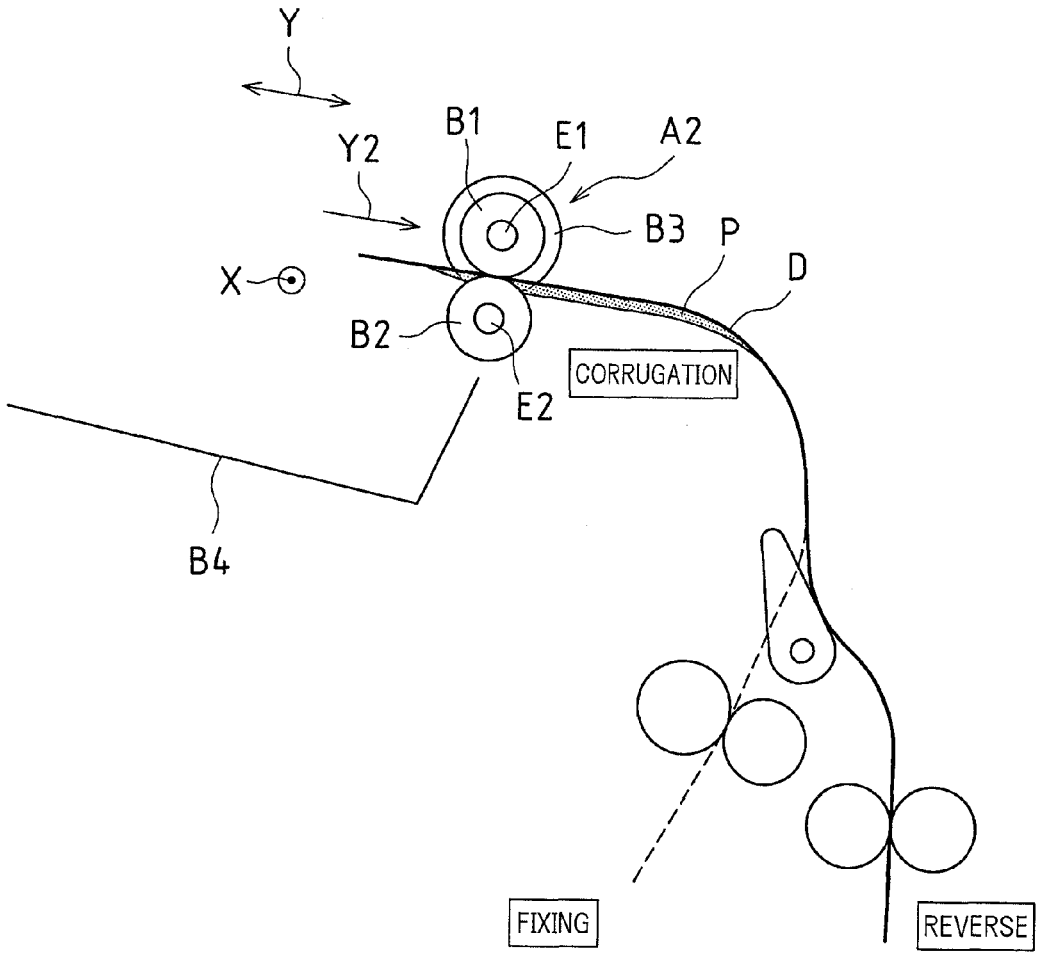
FIG. 11 is a schematic cross-sectional view of an exemplary conventional sheet conveying device illustrating a state where a sheet corrugated in an axial direction is conveyed to a curved conveyance path curved in a conveying direction viewed from the axial direction.

FIGS. 5A to 5D are schematic configuration diagrams of the first and second stiffening rollers 34*a* and 34*b* and their peripheral portion according to the second embodiment. FIG. 5A illustrates a schematic side view of the first stiffening roller 34*a* portion viewed from the conveying direction Y. FIG. 5B illustrates a schematic side view of the first stiffening roller 34*a* portion viewed from the axial direction X. FIG. 5C illustrates a schematic side view of the second stiffening roller 34*b* portion viewed from the conveying direction Y. FIG. 5D illustrates a schematic side view of the second stiffening roller 34*b* portion viewed from the axial direction X.

As illustrated in FIGS. 5A to 5D, the second discharging rollers 32 include the stiffening roller installation portion 32*b* in one side end portion at one side X1 or the other side X2 in the axial direction X.

The first stiffening rollers 34*a* and the second stiffening rollers 34*b* each have a ring shape that has the same outer diameter. The ring shape has an inner diameter approximately the same as an outer diameter of the stiffening roller installation portions 32*b* of the second discharging rollers 32. The first stiffening rollers 34*a* and the second stiffening rollers 34*b* each include the inner peripheral surface 341*a* that is secured to the outer peripheral surface 321*a* of the stiffening roller installation portion 32*b* in the second discharging rollers 32 with an adhesive F.

As illustrated in FIG. 5C and FIG. 5D, the second stiffening rollers 34*b* each have a surface that is coated with a surface layer (here, a releasable resin layer) 342*b* with a friction coefficient smaller than a friction coefficient of surfaces of the first stiffening rollers 34*a*.

Similarly to the first embodiment, in order to reduce the strain (for example, occurrence of scratching and similar strain) on the paper P when corrugating the paper P, the first and second stiffening rollers 34*a* and 34*b* may be constituted of elastic members such as foamable resin.

The foamable resin may employ a material such as polyurethane (specifically, urethane sponge (PORON LE-20 produced by INOAC CORPORATION), silicone rubber, ethylene propylene rubber (EPDM). The resin layer 342*b* may employ, for example, a fluororesin material such as Polytetrafluoroethylene. The first and second discharging rollers 31 and 32 may employ, for example, a resin such as polyacetal (POM) that is excellent in strength and impact resistance.

As illustrated in FIG. 3, in the first and second embodiments, the second discharging rollers 32 and the stiffening rollers 34 (34*a* and 34*b*) are symmetrical with respect to the center in the axial direction X.

Specifically, in the first and second embodiments, the stiffening rollers 34 (34*a* and 34*b*) includes the first stiffening rollers 34*a* at the center portion in the axial direction X and the second stiffening rollers 34*b* at the both end portions.

Specifically, in the axial direction X of the configuration for sheet conveyance with the center reference, the second discharging roller 32, the first stiffening roller 34*a*, the second stiffening roller 34*b*, and the second discharging roller 32 are disposed in this order from the center position 13 (see FIG. 3) of the paper P toward the outside, which are one side X1 and the other side X2 (toward a lateral direction in FIG. 3).

That is, the stiffening roller closest from the center position β in the axial direction X among the stiffening rollers 34 (34*a* and 34*b*) is the first stiffening roller 34*a*.

The stiffening rollers that are closest from the center position β in the axial direction X among the stiffening rollers 34

(34*a* and 34*b*) are configured to convey the paper P with the minimum size (the minimum size such as A6 size) that is usable in the image forming apparatus 100. Specifically, the stiffening rollers that are closest from the center position β are disposed to have a smaller distance in the axial direction X than a width of the paper P in the available minimum size.

With the sheet conveying device 30 described above, the stiffening rollers 34 are constituted of the first stiffening rollers 34*a* and the second stiffening rollers 34*b*. This ensures a simple structure and low cost. The stiffening rollers 34 allow imparting a shape corrugated in the axial direction X to the paper P. Additionally, the stiffening rollers 34 include the first stiffening rollers 34*a* that apply conveying forces to the paper P. This allows avoiding occurrence of rear end remaining of the paper P, thus ensuring stacking quality of the paper P. Additionally, the stiffening rollers 34 do not have a configuration where all the individual stiffening rollers 34 apply conveying forces to the paper P. The stiffening rollers 34 include the second stiffening rollers 34*b* that apply smaller conveying forces to the paper P than conveying forces of the first stiffening rollers 34*a* to the paper P, in addition to the first stiffening rollers 34*a* that apply conveying forces to the paper P. This reduces the difference in conveyance amount of the paper P per unit time by the difference in circumferential speed between the stiffening rollers 34 and the second discharging rollers 32 irrespective of the rotation directions A1 and A2 of the first and second discharging rollers 31 and 32, thus reducing amplitude of corrugation of the paper P. This reduces occurrence of inconvenience (especially, abnormal sound of the paper P conveyed to the reverse conveying path 77) related to the corrugation.

In the first embodiment, the first stiffening rollers 34*a* are configured to integrally rotate with the second discharging rollers 32. Accordingly, the first stiffening rollers 34*a* rotate along with the second discharging rollers 32. The second stiffening rollers 34*b* are disposed pivotally around the axis line with respect to the second discharging rollers 32. In view of this, the second stiffening rollers 34*b* are in a free state where rotation of the second stiffening rollers 34*b* is not restricted together with the second discharging rollers if the second discharging rollers 32 rotate. Accordingly, the first stiffening rollers 34*a* provide conveying forces to the paper P while the second stiffening rollers 34*b* do not provide conveying forces to the paper P. This reduces the difference in conveyance amount of the paper P per unit time due to the difference in circumferential speed between the stiffening rollers 34 (34*a* and 34*b*) and the second discharging rollers 32.

In the second embodiment, the first stiffening rollers 34*a* and the second stiffening rollers 34*b*, which integrally rotate with the second discharging rollers 32, are configured to have the smaller friction coefficient of the surfaces of the second stiffening rollers 34*b* than the friction coefficient of the surfaces of the first stiffening rollers 34*a*. Accordingly, the paper P easily slides on the second stiffening rollers 34*b* compared with the first stiffening rollers 34*a*. This reduces conveying forces to the paper P in the second stiffening rollers 34*b* compared with conveying forces to the paper P in the first stiffening rollers 34*a*. This reduces the difference in conveyance amount of the paper P per unit time by the difference in circumferential speed between the stiffening rollers 34 (34*a* and 34*b*) and the second discharging rollers 32.

In the first and the second embodiments, the stiffening rollers 34 (34*a* and 34*b*) and the second discharging rollers 32 are disposed symmetrically with respect to the center reference in the axial direction X. This applies conveying forces to the paper P symmetrically with respect to the center reference. This prevents occurrence of skew (diagonal feed).

In the first and second embodiments, the stiffening rollers 34 include the first stiffening rollers 34*a* disposed at the center portion in the axial direction X and the second stiffening rollers 34*b* disposed at the both end portions. This reduces occurrence of inconveniences related to corrugation of the paper P while ensuring stable conveyance of the paper P at the center portion in the axial direction X.

In the first and second embodiments, the stiffening rollers that are closest from the center position β in the axial direction X among the stiffening rollers 34 are the first stiffening rollers 34*a*. This allows applying a conveying force near the center position β. Even in the case where the papers P in a plurality of sizes such as from A3 to A6, B4, and B5 are used, this surely conveys the paper P in a size smaller than the maximum size.

In the first and second embodiments, the stiffening rollers 34*a* that are closest from the center position β in the axial direction X among the stiffening rollers 34 are configured to convey the paper P in the minimum size usable in the image forming apparatus 100. This allows surely conveying the paper P even in the minimum size in the configuration for sheet conveyance with the center reference.

In the first and second embodiments, the stiffening rollers 34 are each disposed in the stiffening roller installation portion 32*b*. Compared with a case where the stiffening rollers 34 are distant from the second discharging rollers 32 in the axial direction X (for example, a case where the stiffening rollers 34 are provided with the driven roller shaft 32*a* at the center between the adjacent second discharging rollers 32), this provides a large proportion of amplitude to the difference between the diameters of the stiffening rollers 34 and the diameters of the second discharging rollers 32 even in the case where the corrugations of the paper P have the same maximum amplitude. This consequently reduces material cost. Furthermore, this allows providing the stiffening rollers 34 and the second discharging rollers 32 as one assembly part, thus ensuring reduced assembly processes for the stiffening rollers 34 and the second discharging rollers 32.

While in this embodiment the curved conveyance path (here, the reverse conveying path 77 that constitutes the curved conveyance path) is disposed in the portion where the paper P is conveyed to the other side Y2 in the conveying direction Y and switch backed, this should not be construed in a limiting sense. The curved conveyance path may be disposed in a portion where the paper P is conveyed to one side Y1 in the conveying direction Y. This similarly allows avoiding inconveniences related to the corrugation of the paper P. While in this embodiment the sheet conveying device 30 is disposed in the portion that conveys the paper P where an image is formed, this should not be construed in a limiting sense. The sheet conveying device 30 may be disposed in a portion that conveys the original where an image is read. This similarly allows avoiding inconveniences related to the corrugation of the original.

Embodiment

Next, the occurrence of abnormal sound in the reverse conveying path 77 was examined for each embodiment with the configuration of the first embodiment. The examination results will be described below using Comparative examples 1 and 2.

In Comparative example 1, the image forming apparatus 100 illustrated in FIG. 1 has a configuration where all the individual stiffening rollers 34 integrally rotate with the second discharging rollers 32. In Comparative example 2, the image forming apparatus 100 illustrated in FIG. 1 has a configuration where all the individual stiffening rollers 34 are disposed pivotally around the axis line with respect to the second discharging rollers 32.

FIG. 6 is a table illustrating positional relationships and sizes of outer diameters of the stiffening rollers 34 by destination of the image forming apparatus 100.

As illustrated in FIG. 6, in Japanese (centimeter) specification and North America (inch) specification, outer diameters d1 to d4 of the stiffening rollers 34 were each set to 20 mm. In European (centimeter) specification, outer diameters d2 and d3 of the two stiffening rollers 34 and 34 inside were set to 21 mm while outer diameters d1 and d4 of the two stiffening rollers 34 and 34 outside were set to 20 mm. All the second discharging rollers 32 had an outer diameter d set to 15 mm.

FIG. 7 illustrates results of Comparative examples 1 and 2 and the embodiment. In FIG. 7, "Poor (x)" denotes a case where abnormal sound occurred while "Good (o)" denotes a case where abnormal sound did not occur. Additionally, "Poor (x)" denotes a case where the rear end remaining occurred while "Good (o)" denotes a case where the rear end remaining did not occur. The same applies to FIG. 8 described below. In FIG. 7, "LOCKED" means a configuration where the second discharging roller 32 integrally rotates with the stiffening roller 34. "FREE" means a configuration where the stiffening roller 34 freely rotates with respect to the second discharging roller 32.

As illustrated in FIG. 7, like Comparative example 1, the configuration where all the individual stiffening rollers 34 apply conveying forces to the paper P solves the rear end remaining but causes abnormal sound of the paper P conveyed to the reverse conveying path 77. On the other hand, like Comparative example 2, the configuration where all the individual stiffening rollers 34 do not apply conveying forces to the paper P solves abnormal sound of the paper P conveyed to the reverse conveying path 77 but reduces conveying forces to the paper P. This caused the rear end remaining of the paper P and could not ensure stacking quality of the paper P.

In this respect, like the embodiment, the configuration where a part of the individual stiffening rollers 34 does not apply a conveying force to the paper P solves abnormal sound of the paper P conveyed to the reverse conveying path 77, and also solves the occurrence of rear end remaining of the paper P. This ensured stacking quality of the paper P.

In Comparative example 1 and the embodiment, the occurrence of abnormal sound by each of different kinds of paper P in the reverse conveying path 77 was examined. FIG. 8 illustrates results of the examination.

In Comparative example illustrated in FIG. 8 (*a*), abnormal sound occurred frequently in B4 size/legal (LGL) size and A3 size/double letter (WLT) size. In contrast, in the embodiment illustrated in FIG. 8 (*b*), the occurrence of abnormal sound was not observed in any size.

The present invention can be embodied and practiced in other different forms without departing from the spirit and essential characteristics of the present invention. Therefore, the above-described embodiments and examples are considered in all respects as illustrative and not restrictive. The scope of the invention is indicated by the appended claims rather than by the foregoing description. All variations and modifications falling within the equivalency range of the appended claims are intended to be embraced therein.

This application is based on and claims priority to Japanese Patent Application 2010-177576, filed on Aug. 6, 2010, the entire contents of which are incorporated herein by reference. Furthermore, the entire contents of references cited in the present specification are herein specifically incorporated by reference.

DESCRIPTION OF REFERENCE SIGNS

30 sheet conveying device
31 first discharging roller
31*a* drive roller shaft
32 second discharging roller
32*a* driven roller shaft
32*b* stiffening roller installation portion (one side end portion of second discharging roller)
34 stiffening roller
34*a* first stiffening roller
34*b* second stiffening roller
342*b* surface layer
77 reverse conveying path (exemplary curved conveyance path)
100 image forming apparatus
F adhesive
P paper (exemplary sheet)
X axial direction
Y conveying direction
Y1 one side in conveying direction
Y2 the other side in conveying direction
α rear end remaining portion
β center position

The invention claimed is:

1. A sheet conveying device comprising:

a plurality of first conveyance rollers disposed coaxially with one another;

a plurality of second conveyance rollers that face the respective plurality of first conveyance rollers, the plurality of second conveyance rollers being disposed coaxially with one another, the plurality of second conveyance rollers conveying a sheet while sandwiching the sheet between the second conveyance rollers and the first conveyance rollers to be rotated; and a stiffening roller disposed coaxially with an axis of at least either of the first and second conveyance rollers, wherein the stiffening roller includes a first stiffening roller and a second stiffening roller, the first stiffening roller integrally rotating with the coaxially disposed conveyance rollers and having a larger diameter than the coaxially disposed conveyance rollers, the second stiffening roller freely rotating with respect to the coaxially disposed conveyance rollers and having a larger diameter than the coaxially disposed conveyance rollers.

2. The sheet conveying device according to claim 1, wherein the stiffening roller and the conveyance roller are disposed symmetrically with respect to a center reference in an axial direction of the conveyance roller, the conveyance roller being disposed coaxially with the stiffening roller.

3. The sheet conveying device according to claim 2, wherein the stiffening rollers include the first stiffening roller at a center portion in the axial direction and the second stiffening rollers at both end portions.

4. The sheet conveying device according to claim 3, wherein the first stiffening roller is a stiffening roller positioned closest to the center position in the axial direction among the stiffening rollers.

5. The sheet conveying device according to claim 3, wherein a stiffening roller positioned closest to the center position in the axial direction among the stiffening rollers is configured to convey a sheet in a minimum size usable in an image forming apparatus with the sheet conveying device.

6. The sheet conveying device according to claim 1, wherein the stiffening roller is disposed in one side end portion of the conveyance roller in the axial direction, the conveyance roller being disposed coaxially with the stiffening roller.

7. An image forming apparatus comprising:

the sheet conveying device according to claim 1; and a curved conveyance path curved in a conveying direction of a sheet, wherein the image forming apparatus is configured to convey a sheet from the sheet conveying device toward the curved conveyance path.

8. A sheet conveying device comprising:

a plurality of first conveyance rollers disposed coaxially with one another;

a plurality of second conveyance rollers that face the respective plurality of first conveyance rollers, the plurality of second conveyance rollers being disposed coaxially with one another, the plurality of second conveyance rollers being configured to conveying a sheet while sandwiching the sheet between the second conveyance rollers and the first conveyance rollers to be rotated; and a stiffening roller disposed coaxially with an axis of at least either of the first and second conveyance rollers, wherein the stiffening roller includes a first stiffening roller and a second stiffening roller, the first stiffening roller applying a conveying force to the sheet and having a larger diameter than the conveyance rollers coaxially disposed with the first stiffening roller, the second stiffening roller applying a smaller conveying force to the sheet than the conveying force to the sheet by the first stiffening roller and having a larger diameter than the conveyance rollers coaxially disposed with the second stiffening roller, and the first stiffening roller and the second stiffening roller each have a same outer diameter.

9. The sheet conveying device according to claim 8, wherein the first stiffening roller is configured to integrally rotate with a conveyance roller, the conveyance roller being disposed coaxially with the first stiffening roller, and the second stiffening roller is configured to freely rotate with respect to a conveyance roller, the conveyance roller being disposed coaxially with the second stiffening roller.

10. An image forming apparatus comprising:

the sheet conveying device according to claim 8; and a curved conveyance path curved in a conveying direction of a sheet, wherein the image forming apparatus is configured to convey a sheet from the sheet conveying device toward the curved conveyance path.

11. A sheet conveying device comprising:

a plurality of first conveyance rollers disposed coaxially with one another;

a plurality of second conveyance rollers that face the respective plurality of first conveyance rollers, the plurality of second conveyance rollers being disposed coaxially with one another, the plurality of second conveyance rollers being configured to convey a sheet while sandwiching the sheet between the second conveyance rollers and the first conveyance rollers to be rotated; and a stiffening roller disposed coaxially with either or both of the first and second conveyance rollers, the stiffening roller having a diameter larger than a diameter of either or both of the first and second conveyance rollers, wherein the stiffening roller includes a first stiffening roller and a second stiffening roller, the first stiffening roller applying a conveying force to the sheet, the second stiffening roller applying a smaller conveying force to the sheet than the conveying force to the sheet by the first stiffening roller, the first stiffening roller and the second stiffening roller are configured to integrally rotate with the respective conveyance rollers, the first and second stiffening rollers being disposed coaxially with the respective conveyance rollers, and a friction coefficient of a surface of the second stiffening roller is smaller than a friction coefficient of a surface of the first stiffening roller.

12. An image forming apparatus comprising:

the sheet conveying device according to claim 11; and a curved conveyance path curved in a conveying direction of a sheet, wherein the image forming apparatus is configured to convey a sheet from the sheet conveying device toward the curved conveyance path.

13. The sheet conveying device according to claim 1, wherein the first and second stiffening rollers are disposed coaxially with each other.

14. The sheet conveying device according to claim 1, wherein the second stiffening roller applies a smaller conveying force to the sheet than the first stiffening roller.

15. The sheet conveying device according to claim 11, wherein the stiffening roller and the conveyance roller are disposed symmetrically with respect to a center reference in an axial direction of the conveyance roller, the conveyance roller being disposed coaxially with the stiffening roller.

16. The sheet conveying device according to claim 15, wherein the stiffening rollers include the first stiffening roller at a center portion in the axial direction and the second stiffening rollers at both end portions.

17. The sheet conveying device according to claim 16, wherein the first stiffening roller is a stiffening roller positioned closest to the center position in the axial direction among the stiffening rollers.

18. The sheet conveying device according to claim 16, wherein a stiffening roller positioned closest to the center position in the axial direction among the stiffening rollers is configured to convey a sheet in a minimum size usable in an image forming apparatus with the sheet conveying device.

19. The sheet conveying device according to claim 11, wherein the stiffening roller is disposed in one side end portion of the conveyance roller in the axial direction, the conveyance roller being disposed coaxially with the stiffening roller.

20. The sheet conveying device according to claim 11, wherein the first stiffening roller is made of a foamable resin elastic member, and the second stiffening roller has a surface layer which comprises a releasable resin layer having a smaller friction coefficient than the surface of the first stiffening roller.

* * * * *